US009890546B2

(12) United States Patent
Ehsani

(10) Patent No.: US 9,890,546 B2
(45) Date of Patent: Feb. 13, 2018

(54) REINFORCEMENT AND REPAIR OF STRUCTURAL COLUMNS

(71) Applicant: Mohammad Reza Ehsani, Tucson, AZ (US)

(72) Inventor: Mohammad Reza Ehsani, Tucson, AZ (US)

( * ) Notice: Subject to any disclaimer, the term of this patent is extended or adjusted under 35 U.S.C. 154(b) by 0 days.

(21) Appl. No.: 14/555,539

(22) Filed: Nov. 26, 2014

(65) Prior Publication Data

US 2016/0145882 A1 May 26, 2016

(51) Int. Cl.
*E04G 23/02* (2006.01)
*E04C 3/30* (2006.01)
*E04H 12/22* (2006.01)

(52) U.S. Cl.
CPC ..... *E04G 23/0218* (2013.01); *E04C 3/30* (2013.01); *E04G 23/0225* (2013.01); *E04H 12/2292* (2013.01)

(58) Field of Classification Search
CPC ..... E04H 12/2292; E04G 23/0225; E04G 23/0214; E04G 23/0218; E04G 2023/0251; E04C 3/18
See application file for complete search history.

(56) References Cited

U.S. PATENT DOCUMENTS 2,897,553 A * 8/1959 Gorrow ..... 52/835
3,429,758 A * 2/1969 Young ..... 156/79
3,798,867 A * 3/1974 Starling ..... E02D 5/64 52/742.14
3,890,795 A * 6/1975 Maurer ..... E02D 5/60 24/197
4,019,301 A * 4/1977 Fox ..... 52/834
4,068,483 A * 1/1978 Papworth ..... E02D 5/60 264/32
4,071,996 A * 2/1978 Muto ..... E04H 9/02 264/35
4,306,821 A * 12/1981 Moore ..... E02D 5/64 405/211
4,439,071 A * 3/1984 Roper, Jr. ..... E02D 5/60 249/48
4,543,764 A * 10/1985 Kozikowski ..... E02D 5/60 405/216

(Continued)

*Primary Examiner* — Gisele D Ford
(74) *Attorney, Agent, or Firm* — Arjomand Law Group, PLLC

(57) ABSTRACT

A method and an article of manufacture are presented for reinforcing and/or repairing columns, towers, pylons, and the like, constructed from various materials including concrete, masonry, wood, plastics, and the like. One or more tensile bearing bands/rebars of material, such as fibrous material, are longitudinally/axially adhered or attached to the structure followed by wrapping of a semi-flexible or a semi-rigid sheet of material, at a relatively small distance, around the column. Subsequently filler material is poured in the cavity created between the wrapped sheet material and the column. Optionally, multiple layers of various material sheets, each sheet having substantially the same or different properties, may be wrapped around or be attached to the primary wrapped sheet. Appropriately chosen reinforcement bands/rebars, reinforcement sheets, and filler material can provide any desired additional tensile, compressive, shear and flexural strength to the column.

20 Claims, 6 Drawing Sheets

(56) References Cited

U.S. PATENT DOCUMENTS 4,702,057 A * 10/1987 Phillips ..... E04H 12/2292 52/170
4,779,389 A * 10/1988 Landers ..... E02D 27/42 405/216
4,892,601 A * 1/1990 Norwood ..... 156/94
4,921,555 A * 5/1990 Skiff ..... B29C 73/025 156/215
4,987,718 A * 1/1991 Knight ..... E04H 12/2292 52/170
5,043,033 A * 8/1991 Fyfe ..... 156/71
5,138,806 A * 8/1992 Marx et al. ..... 52/170
5,175,973 A * 1/1993 Owen et al. ..... 52/741.14
5,218,810 A * 6/1993 Isley, Jr. ..... E04C 3/34 52/249
5,326,410 A * 7/1994 Boyles ..... B29C 65/342 156/188
5,444,952 A * 8/1995 Jackson ..... E04C 5/00 52/167.1
5,447,593 A * 9/1995 Tanaka ..... E04C 3/29 156/306.9
5,542,229 A * 8/1996 Saito ..... E04H 12/2292 52/745.17
5,591,265 A * 1/1997 Tusch ..... E02B 17/0026 118/404
5,591,291 A * 1/1997 Blackmore ..... 156/173
5,633,057 A * 5/1997 Fawley ..... 428/36.1
5,799,451 A * 9/1998 Pilakoutas ..... E04C 3/26 52/223.4
5,879,778 A * 3/1999 Barnes ..... E04G 23/0218 427/140
5,899,044 A * 5/1999 Jarrett ..... 52/834
5,924,262 A * 7/1999 Fawley ..... 52/834
5,960,597 A * 10/1999 Schwager ..... E04G 23/0218 242/160.2
6,219,986 B1 * 4/2001 Ouchi ..... E04G 23/0218 52/425
6,219,988 B1 * 4/2001 Mahfouz ..... E04C 3/34 52/834
6,219,991 B1 * 4/2001 Salek-Nejad ..... 52/741.3
6,241,422 B1 * 6/2001 Makowski ..... 405/79
6,247,279 B1 * 6/2001 Murat ..... E04C 3/34 52/223.13
6,276,105 B1 * 8/2001 Wycech ..... 52/309.8
6,457,289 B1 * 10/2002 Scherer ..... E04C 5/07 156/71
6,536,991 B1 * 3/2003 Trader ..... E02D 5/64 405/211
6,964,141 B2 * 11/2005 Igarashi ..... 52/746.1
6,997,260 B1 * 2/2006 Trader ..... E21B 29/10 138/99
7,300,229 B1 * 11/2007 Fyfe ..... E02D 5/64 405/211
7,533,509 B2 * 5/2009 Li ..... E04C 5/02 52/251
7,987,638 B1 * 8/2011 Fang ..... E04G 23/0218 52/167.1
8,484,915 B1 * 7/2013 Abbas ..... E04C 3/34 405/232
8,757,933 B2 * 6/2014 Li ..... E02B 17/0008 405/225
8,888,414 B2 * 11/2014 Hall ..... E02D 5/48 405/216
9,353,536 B2 * 5/2016 Yamakawa ..... E04G 23/0225
9,566,748 B2 * 2/2017 Chou ..... B29C 70/86
2002/0094239 A1 * 7/2002 Bradley ..... E02B 17/0026 405/216
2003/0089063 A1 * 5/2003 Igarashi ..... E04G 23/0218 52/405.2
2004/0074199 A1 * 4/2004 Gordin et al. ..... 52/726.4
2004/0154263 A1 * 8/2004 Li ..... E04C 3/34 52/831
2006/0060286 A1 * 3/2006 Fyfe ..... E04G 23/0218 156/94
2007/0245645 A1 * 10/2007 Nesbitt ..... 52/169.9
2008/0155827 A1 * 7/2008 Fyfe ..... E04G 23/0218 29/897.1
2009/0020680 A1 * 1/2009 Bradac ..... 249/98
2009/0108170 A1 * 4/2009 Penza ..... E04G 13/021 249/48
2009/0165404 A1 * 7/2009 Choi ..... E04C 3/34 52/167.1
2009/0266026 A1 * 10/2009 Hannay et al. ..... 52/745.17
2010/0176543 A1 * 7/2010 Burke et al. ..... 267/153
2011/0056170 A1 * 3/2011 Lowe ..... 52/835
2011/0277410 A1 * 11/2011 Richardson ..... E04G 23/0218 52/426
2012/0180895 A1 * 7/2012 Brattain ..... 138/118.1
2013/0014468 A1 * 1/2013 Ehsani ..... 52/741.3
2013/0288068 A1 * 10/2013 Bernard ..... 428/595
2013/0333324 A1 * 12/2013 Carhart ..... 52/835
2014/0144095 A1 * 5/2014 Blaszak ..... D03D 13/00 52/514
2015/0190972 A1 * 7/2015 Ehsani ..... E04G 23/0218 156/71

* cited by examiner

REINFORCEMENT AND REPAIR OF STRUCTURAL COLUMNS

CROSS-REFERENCE(S) TO RELATED APPLICATION(S)

This application is related to U.S. patent application Ser. No. 13/409,688, filed on Mar. 1, 2012, and U.S. patent application Ser. No. 13/439,722, filed on Apr. 4, 2012, and U.S. patent application Ser. No. 13/859,596, filed on Apr. 9, 2013, and U.S. patent application Ser. No. 12/618,358, filed on Nov. 13, 2009.

TECHNICAL FIELD

This application relates generally to construction. More specifically, this application relates to a method and apparatus for reinforcing and/or repairing structural columns.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1A:
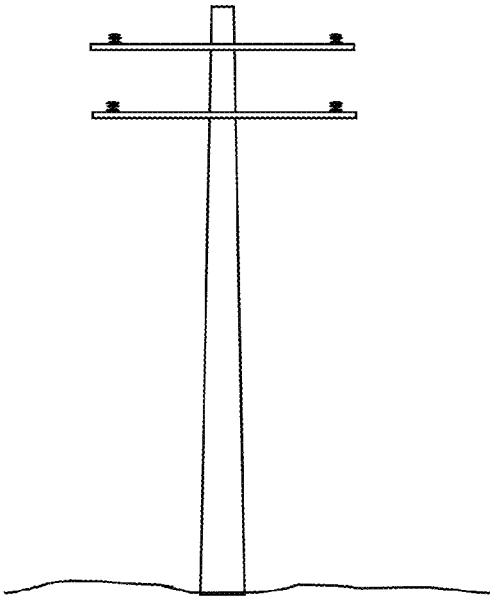
FIGS. 1A-1C show example "columns" suitable to be reinforced and/or repaired by the present methods and apparatus.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description often references using fibrous materials, it will be appreciated that the disclosure may include other materials to add to the tensile or compressive strength of the column in different or multiple directions.

Briefly described, a method and an article of manufacture are disclosed for reinforcing various structural columns of various materials, such as wood or concrete columns of electric poles, steel or concrete poles and towers for support of cellular phone antennas, concrete columns between different floors of buildings, columns of large billboards, etc., but not limited to steel, concrete, masonry, wood, plastics, and the like. Multiple layers of various material sheets, each sheet having substantially the same or different properties, may be used as an outer shell for pouring of filler materials, such as concrete or adhesive, into the cavity between the column and the outer shell. The outer shell itself can be intended and designed to add to the tensile strength of the surface of the completed and reinforced column. It can also be designed to provide confining pressure around the column being repaired. In many embodiments, since it is preferable not to substantially add to the diameter of the column and since much of the reinforcement tensile or compressive strength is accomplished by components placed in the cavity between the outer shell and the column, a single thin sheet of semi-rigid outer shell suffices. In some embodiments improving the "ring stiffness" is less important than improving the bending capacity and strength of the column.

Structural repair can be expensive, cumbersome, and time consuming. Structures can get damaged due to a variety of factors, such as earthquakes, overloading, weight of traffic, wear and tear, corrosion, explosions and the like. One of the problems with existing concrete columns or wooden poles is that they are subject to corrosion and/or natural elements that weaken these structures. The disclosed methods may be employed as a preventive measure and/or for repair of a damaged column. However, it is generally easier and more cost-effective to strengthen a structure that may be exposed to damaging forces and loads, than waiting to repair such eventual damages after they occur. Intentional damage inflicted upon infrastructure, by terrorism or vandalism, is another way that structural damage may result. For example, recently, there has been growing interest to strengthen the above-mentioned structures for blast loading, such as terrorist attacks, which may seek to blow up a building or topple a power pole by placing a bomb adjacent to the column and detonating it. In addition to prevention, if damage does occur to a structure, a cost-effective and speedy method of repair is clearly desirable.

Figure 1B:
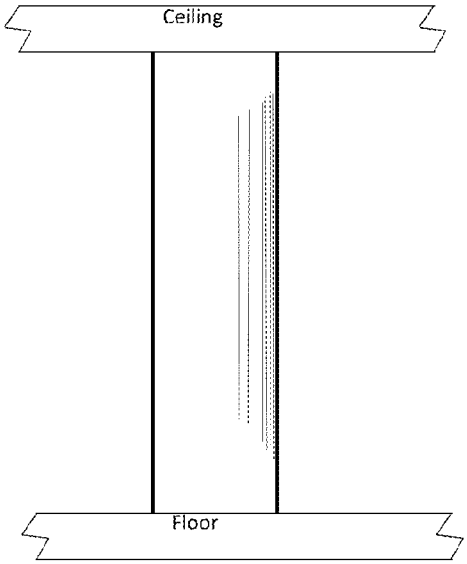
Figure 1C:
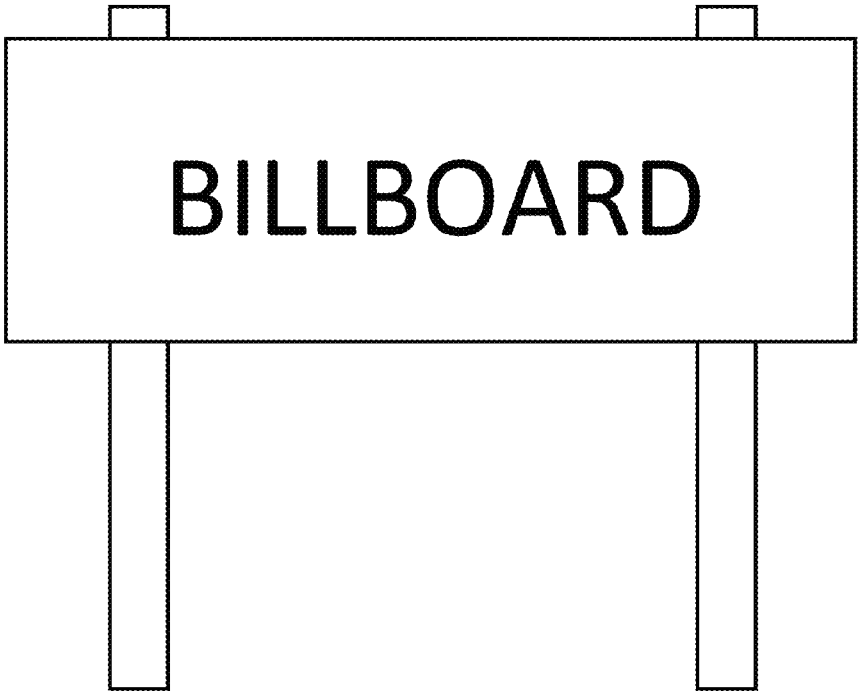

FIGS. 1A-1C show example "columns" suitable to be reinforced by the present methods and apparatus. FIG. 1A shows a wooden electric pole that is constantly exposed to natural elements which weakens the wood in addition to forcing it to bend, such as by wind or by tension in its electrical wires. FIG. 1B illustrates a typical concrete column between two floors of a building. Different forces acting on the building, such as those resulting from an earthquake or a storm, will create different moments and forces in different sections of each of the building columns. FIG. 1C shows an advertisement billboard that is frequently exposed to winds from different directions which induce simple or complex moments and forces in the billboard's supporting columns. The columns in these structures, regardless of the geometry of their cross-section, can benefit from reinforcement by the present methods, whether they are damaged or as a preventive measure.

Figure 2A:
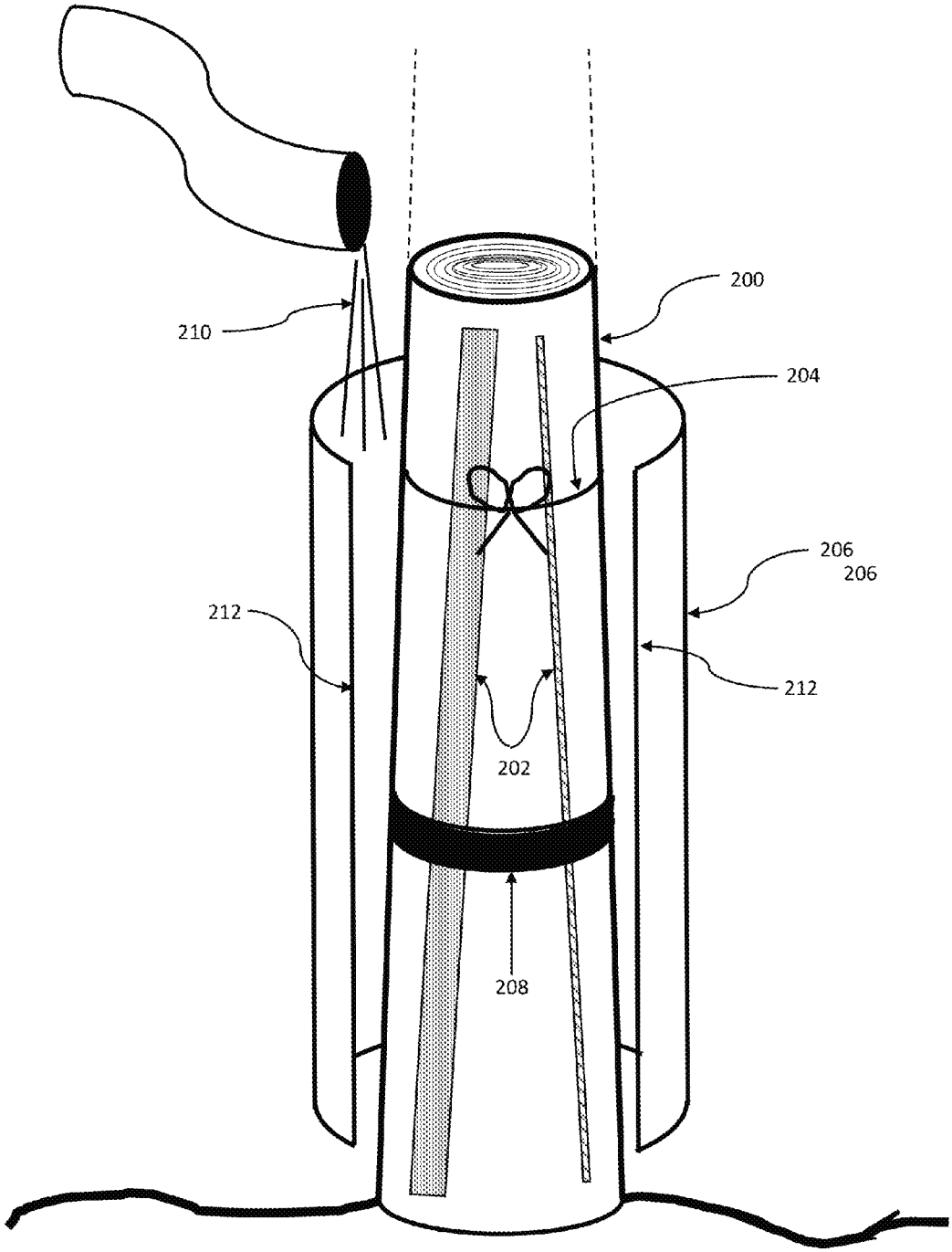
FIGS. 2A-2C show example components employed to reinforce the columns illustrated in FIGS. 1A-1C, using the present methods.

FIG. 2A shows example components employed to reinforce column 200 (electric pole) illustrated in FIG. 1A, using an embodiment of the present methods. In this embodiment tension bearing elements 202 are longitudinally placed against column 200. In some embodiments the tension bearing elements 202 may be in the form of ribbons or straps of fibrous materials such as GU50C Carbon Strips sold by QuakeWrap Inc. of Tucson, Ariz.; in other embodiments they may be rebars. In various embodiments, the tension bearing elements 202 may be adhered to column 200, for example by glue or epoxy, or may be merely held against or at a relatively small distance from the column 200 by a tie-wrap or rope 204. It is important to note that the width of a tension bearing strap may be equivalent or even more than the circumference of column 200 and be able to even completely wrap around column 200 widthwise.

In various embodiments it may be desirable to have tension bearing components wrapped around the column instead or in addition to the longitudinal tension bearing components. An example of such circumferential tension bearing components is component 208 shown in FIG. 2A. This is different from the above mentioned longitudinal tension bearing strap 202 which, because of its wide width, may be also wrapped around column 200. The circumferential components may be wrapped in simple loops or spirally along part or the entire length of the column 200. If used in addition to the longitudinal components, the circumferential components may be wrapped directly around the column—between the longitudinal components and the column—or wrapped over the longitudinal components after the longitudinal components are attached to the column, such that the longitudinal components are between the circumferential components and the column.

As further illustrated in FIG. 2A, a semi-rigid/semi-flexible sheet 206 is wrapped around the assembly/combination of the column 200 and the tension bearing component(s) 202 and 208 to form a shield. In some embodiments edges 212 of sheet 206 meet, overlap and are glued together to create a complete shell around column 200. As an example, sheet 206 can be a carbon laminate PLC100.60 or a glass laminate PLG60.60 sold by PileMedic, LLC in Tucson, Ariz. When sheet 206 is wrapped continuously one or more time around the column, it creates a confining pressure that further strengthens the column. In other embodiments edges 212 of sheet 206 may be butt-joined and in some embodiments these edges may not even be permanently connected, as will be discussed below. After completion of the shield, desired filler material 210 is poured in the cavity between the shield (sheet 206) and column 200.

In some embodiments the tension bearing elements, for example rebars, may be firmly connected to the foundation over which the column is erected. Some examples of the tension bearing elements are steel reinforcing bars, prestressing or post-tensioning strands and wires, nonmetallic rods and strips such as Carbon FRP, etc. In columns, such as the one shown in FIG. 1B, the ends of the tension bearing elements may be embedded in the floor and/or the ceiling between which the column stands.

Figure 2B:
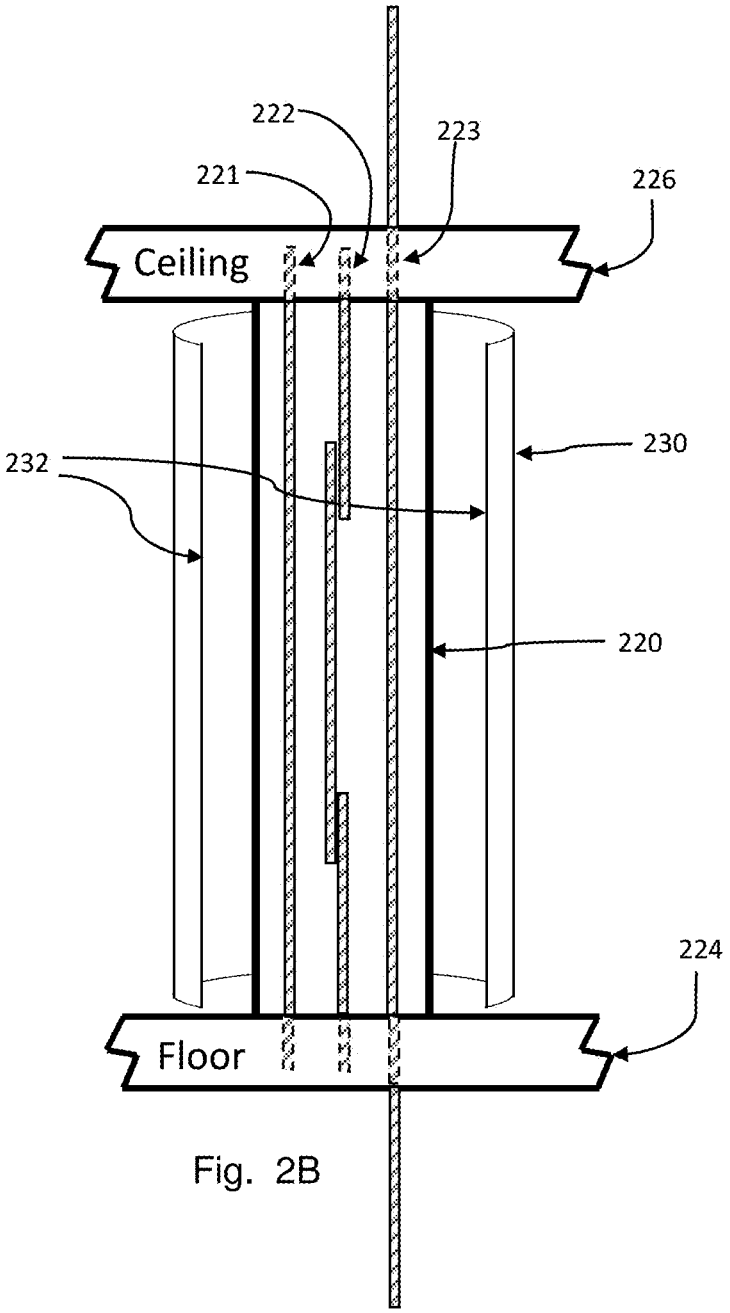

In the embodiment shown in FIG. 2B, column 220 is constructed over floor 224 and under ceiling 226. In this embodiment one end of rebars 221 is fixed by epoxy or any other appropriate glue in a hole in floor 224 and the other end of rebars 221 is fixed by epoxy or any other appropriate glue in another hole in ceiling 226. In another embodiment it may be easier to epoxy anchor shorter rebars in the ceiling and floor and then overlap a third piece of rebar with these two shorter bars to create a continuous rebar piece. This is illustrated by three-piece-rebar 222 in FIG. 2B. In some embodiments it may be possible to run a long rebar 223, for example even as long as the height of a building, through floors and ceilings of multiple floors of the building to reinforce multiple columns that are placed on top of each other.

"Anchor" means fix or fasten to mainly resist a pulling force to the degree that the anchoring means fails before it dislodges from the anchoring point. For example, the following quotes are from chapter 17 of "Building Code Requirements for Structural Concrete (ACI 318-14)" which is dedicated to "anchoring." Section 17.2.3.4.3 (a) states: "For single anchors, the concrete-governed strength shall be greater than the steel strength of the anchor . . . ." (This means the concrete must be strong enough to allow the steel anchor to yield in tension). Section 17.2.3.4.3 (b) states: "The anchor or group of anchors shall be designed for the maximum tension that can be transmitted to the anchor or group of anchors based on the development of a ductile yield mechanism . . . ." (Again, this is requiring the anchor or group of anchors to yield in tension before it gets pulled out of the group). Section 17.2.3.5.3 (a) states: "The anchor or group of anchors shall be designed for the maximum shear that can be transmitted . . . based on the development of a ductile yield mechanism . . . ." And in section 17.4.1.2 the Code provides an equation for how to calculate the strength of an anchor in tension by taking the cross sectional area of the anchor multiplied by a value that is 1.9 times the yield strength of the anchor. All of the above indicate the significance of anchorage and the measures that must be taken to prevent premature (pullout) of the anchor.

The other source is a textbook on "Reinforced Concrete Mechanics and Design." $5^{th}$ edition, by Wight and MacGregor. This book discusses how steel stirrups must be anchored so that they fail by yielding of the steel, which is to make sure the steel reaches its ultimate strength before it pulls out of the concrete block. Here are a few quotes from this book: "Equations 6-21 and 6-18 (which are used in the ACI Building Code) are based on the assumption that the stirrups will yield at ultimate . . . ." "Assuming that all the stirrups yield at failure, the shear resisted by stirrup is . . . ." Also on FIG. 6-26 it can be seen that the force shown on each stirrup is equal to the area of stirrup times its yield strength.

As illustrated in FIG. 2B, a semi-rigid/semi-flexible sheet 230 is wrapped around the assembly/combination of column 220 and the tension bearing component(s) 221, 222, and/or 223. In some embodiments the edges 232 of sheet 230 overlap and are glued together to create a complete shell around column 220. In other embodiments the edges 232 of sheet 230 may be butt-joined and in some embodiments the edges 232 of sheet 230 may not be permanently joined or adhered to each other, as will be discussed below. In some embodiments the edges 232 may be placed side by side and a tape, overlapping both edges, be placed over both edges 232 to keep them adjacent to each other.

Figure 2C:
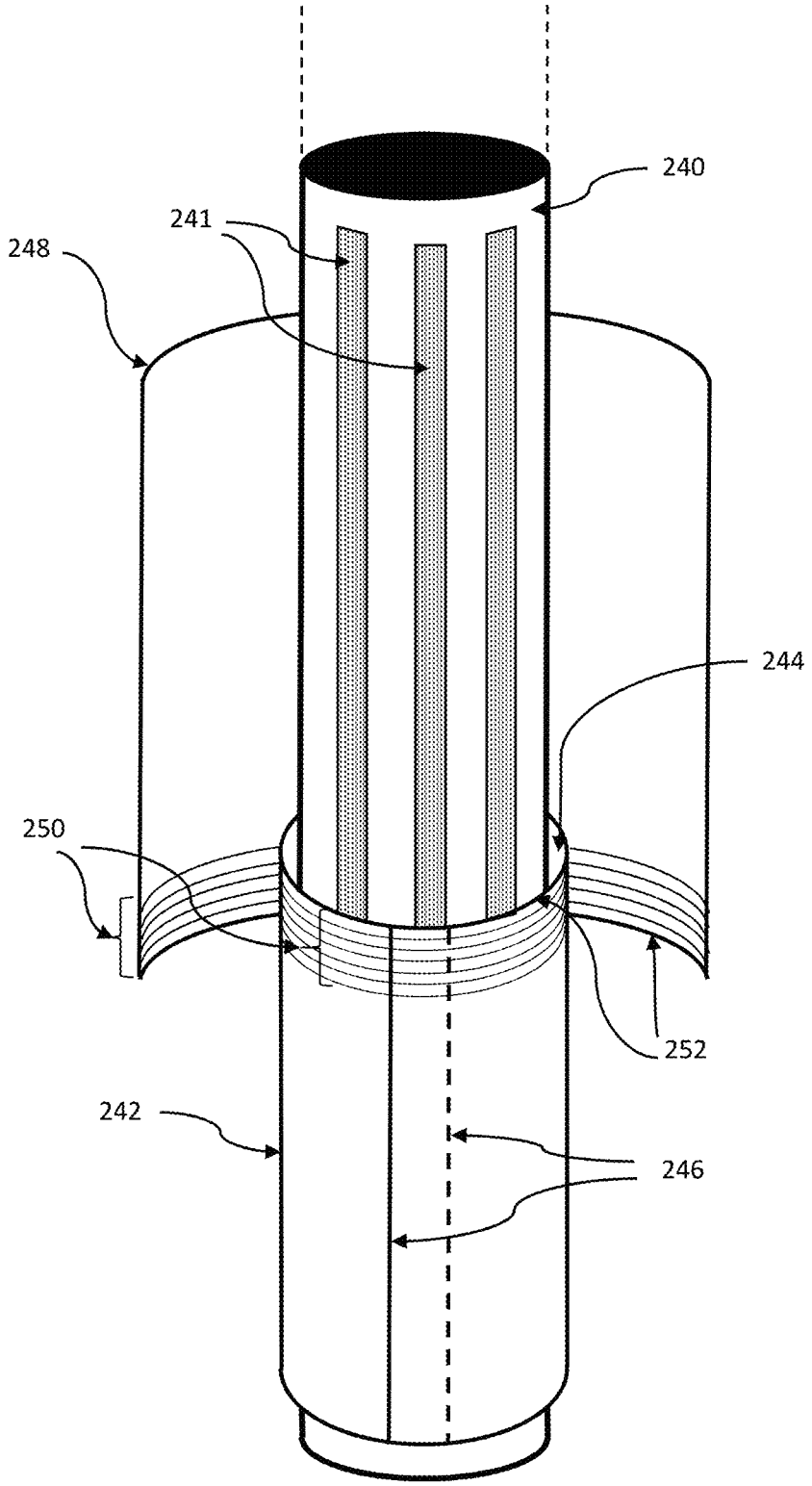

In FIG. 2C, the radial distance of shell-section 242 from the column surface 240 creates a cavity 244 that is filled by any desired kind of filler materials, such as concrete, grout, polymer-modified grout, epoxy grout, just epoxy, or the like. It is preferable to have mounted tensile straps 241 on column 240 before the filler material is poured or even before shell-section 242 is created. In various embodiments the semi-rigid/semi-flexible shell material may be chosen so that shell-section 242 itself contributes noticeably to the strengthening of the reinforced column. As an example, the sheet 206 can be a carbon laminate PLC100.60 or a glass laminate PLG60.60 sold by PileMedic, LLC in Tucson, Ariz. In some embodiments, such as the one illustrated by FIG. 2C, the shell-section 242 may be formed by wrapping the semi-rigid/semi-flexible sheet, overlappingly, around column 240. As can be clearly seen in FIG. 2C, edges 246 show the limits of the overlapping area of shell-section/shield-section 242, which may be held together by epoxy, glue, screws, tong and groove joints or the like. The semi-rigid/semi-flexible sheet may be wrapped around column 240 one or more times, or different or separate sheets may be used to wrap around column 240. The semi-rigid/semi-flexible sheet may even be wrapped spirally around column 240.

The process of wrapping the semi-rigid/semi-flexible sheet around column 240, or even pouring of the filler material, may be performed in sections along the length of the column in an incremental manner until the entire column or a desired part of it is reinforced. The circular/circumferential edges 252 of the adjacent shell sections may be overlapped, as shown in FIG. 2C, and adhered to each other to ensure the tensile (and compressive, if desired) integrity of the completed shell, while at the same time sealing the shell to prevent leakage of the filler material during construction and intrusion of moisture and oxygen once the shell is installed. Those skilled in the art recognize that such oxygen or moisture intrusion serves as a fuel to the corrosion process which can continue the deterioration of the column. The joints between shell sections may be joined shut using epoxy, chemical, or thermal techniques. In FIG. 2C, the overlap width 250 shows the extent of overlap of shell-section 242 and shell-section 248. While butt-joining these two sheets is another possibility, overlapping them is simpler in practice. The filler material may be poured after completing each shell-section 242 and 248 or after completing all shell-sections including 242 and 248.

After the filler and other adhesive material are cured, the completed reinforced assembly of column 240, the tension components 241, the filler material, and the joined shell-sections 242 and 248 is a new and stronger column which contains the original column 240 in its core. Each component of this assembly is a degree of freedom for designing the reinforcement and/or the repair of column 240 and for accomplishing a desired final shape, size, and strength. It is known to those skilled in the art that by appropriate choice of these reinforcement components, the desired improvement in the axial, shear and flexural strength of a column can also be achieved. Additionally, all reinforcement components of the present method may be designed such that they also contribute to the axial, shear and flexural strengthening of a column.

In various embodiments in which the filler material adheres/attaches to the shield, the edges of the sheet forming the shield may be permanently left unattached to each other. In such embodiments a curved sheet of semi-flexible material may be placed around the column, and because such a sheet can keep its cylindrical shape, there may be no need to permanently attach its longitudinal edges together; especially if there is no need for confining pressure around the column.

In various embodiments, the shell sheet is constructed from fiber-reinforced material, such as Fiber Reinforced Polymer (FRP) to give the sheets more resistance against various types of loading, such as blast loading. Those skilled in the art will appreciate that many types of reinforcement fibers may be used for reinforcement including polymer, fiberglass, metal, cotton, other natural fibers, and the like. The sheet materials may include fabrics made with fibers such as glass, carbon, Kevlar, basalt, Nomex, aluminum, and the like; some saturated with a polymer such as polyester, vinyl ester, or epoxy for added strength, wear resistance, and resilience. The fibers within a reinforcement sheet may be aligned in one direction, in cross directions, randomly oriented, or in curved sections to provide various mechanical properties, such as tearing tendency and differential tensile strength along different directions, among others. Different reinforcement layers may use sheets with fibers oriented in different directions, such as orthogonal directions, 3-D fabrics, etc. with respect to other sheets to further reinforce the shell or, in other words, the Structural Reinforcement Wrap (SRW).

The semi-flexible or semi-rigid sheets from which shells/shields are formed, are preferably manufactured, transported, and stored as flat sheets, although curved sheets may also be used.

In various embodiments, multiple honeycomb laminates may be employed to further reinforce the SRW. Various layers in the SRW may be glued to each other to form one integral laminate wrap. In some embodiments, each layer in the SRW may be made from a different or same type of reinforcement sheet to develop different costs, performances, and mechanical properties for the SRW. For example, the outer layers may be made from thicker and tougher reinforcement sheets while the inner layers (closer to the structure) may be made from thinner and more flexible sheets to save material and installation or construction costs. Other variations in sheet layers are possible, such as fiber types and orientations, sheet materials, sheet material properties like chemical resistance, heat resistance, gas and fluid impermeability, and the like. Shells made with such variations in reinforcement layers will exhibit different mechanical and chemical properties suitable for different applications, costs levels, and considerations such as environmental and public safety considerations.

Shorter shells (shorter than the desired height of the completed/final shell) may be wrapped around the column at one elevation and then pushed up or down to their final elevation before grout is placed. This offers unique advantages, for example for repair of submerged piles where the shell is created above the water and then it is pushed down into water, eliminating the need for costly divers on such repairs.

The multi-layer embodiments may be pre-glued and integrated prior to application to a structure or be integrated during the application to the structure.

When concrete is poured in the cavity between the shell and the column to reinforce the structure, a stiff SRW may be used to support the weight of the fresh concrete or grout before the concrete or grout sets and cures. SRW eliminates the framework sometimes needed to support concrete repair and/or reinforcement. In rare cases when additional support is needed while the concrete or grout is being cured, temporary support may be used around the shell. In some embodiments a ring, ledge or a lip near the bottom of the shell may also be used to support the weight of the fresh concrete or grout, at the bottom of the shell, before the concrete or grout sets and cures.

In various embodiments the shell-based/SRW-based outer lining may have very high ring stiffness and may prevent further erosion and deterioration of the column. In an optional step of reinforcement process, one or both ends of a shield may be connected to or embedded in the floor and/or ceiling on which or between which the column is built. This is in addition or instead of connecting the reinforcement straps/rebars to the floor and/or the ceiling, as mentioned above.

Those skilled in the field know that the reinforcement sheet may be kept at a distance from the column, while being wrapped around it, by different conventional means or by using a reinforcement sheet that includes protrusions on one side. By using such sheets the shell/SRW becomes an integral part of the filler material and a much stiffer system results, while eliminating the need for temporary or permanent spacers otherwise needed.

Figure 3A:
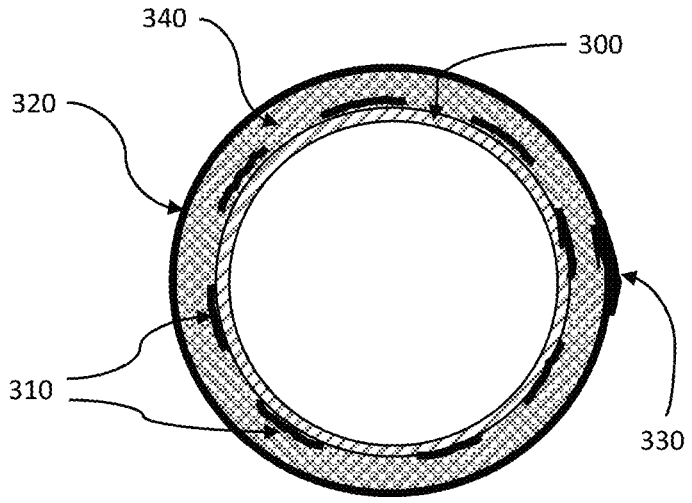
FIGS. 3A and 3B show cross-sectional areas of two example reinforced columns.

FIG. 3A shows example cross-sectional area of a reinforced column 300. In this embodiment column 300 is hollow, such as a pipe. As can be seen in FIG. 3A, the combination of column 300, straps 310, filler material 340, and shell 320 creates a thicker-walled column that can withstand higher compressive forces while bending or under axial pressure. In this example shell 320 is axially/longitudinally sealed by overlap 330. Additionally in this example, the tension bearing elements 310, which are also a part of the above mentioned combination of column 300, filler material 340, and shell 320, will add to the tensile capacity of the column under bending moments. While the tension bearing elements 310 may be even attached to the inside or the outside surface of shell 320, attaching them to the outside surface of column 300 is more practical.

Figure 3B:
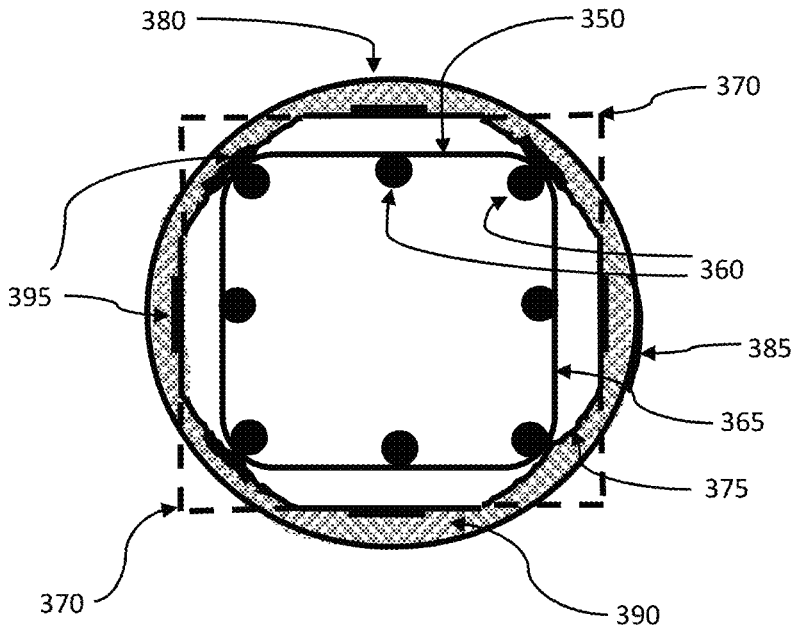

FIG. 3B shows example cross-sectional area of a rectangular reinforced concrete column 350 that was originally constructed with longitudinal reinforcing steel bars 360 and lateral steel ties 365. In many cases it is desirable to strengthen such columns with as little enlargement of the original cross section as possible. In one embodiment, the corners 370 of the column 350 can be cut and removed to reach new sides 375. The shell 380 is wrapped around the column and it is axially/longitudinally sealed by overlap 385. Tension reinforcing elements 395 can be positioned along the axis of the column and the annular space between the shell 380 and the column is filled with a filler material 390. Those skilled in the art recognize that by designing the number of layers of overlap of shell 380 and the length of overlap 385, the shell can offer very high confining pressure and can also eliminate the need for new lateral ties. The shell 380, the reinforcing elements 395 and the filler material 390 all contribute to the increase in axial, flexural and shear capacity of the original column 350. For a video of testing the disclosed methods on concrete and wood columns please visit http://goo.gl/HRHzjr and http://goo.gl/vxf1Mx respectively.

In the embodiments in which the reinforcement rebars or other reinforcement members are securely attached inside holes that are drilled in the floor and/or ceiling, a slightly larger size column will result that will have a construction similar to the original column but with more reinforcement components. Especially in such reinforced concrete columns the completed column is not a combination of an original column and a reinforcement cover, but a new column with same construction as the original column with more reinforcement members. In effect, with such concrete reinforced columns there is no distinction between the original column and the reinforcement part.

Figure 4:
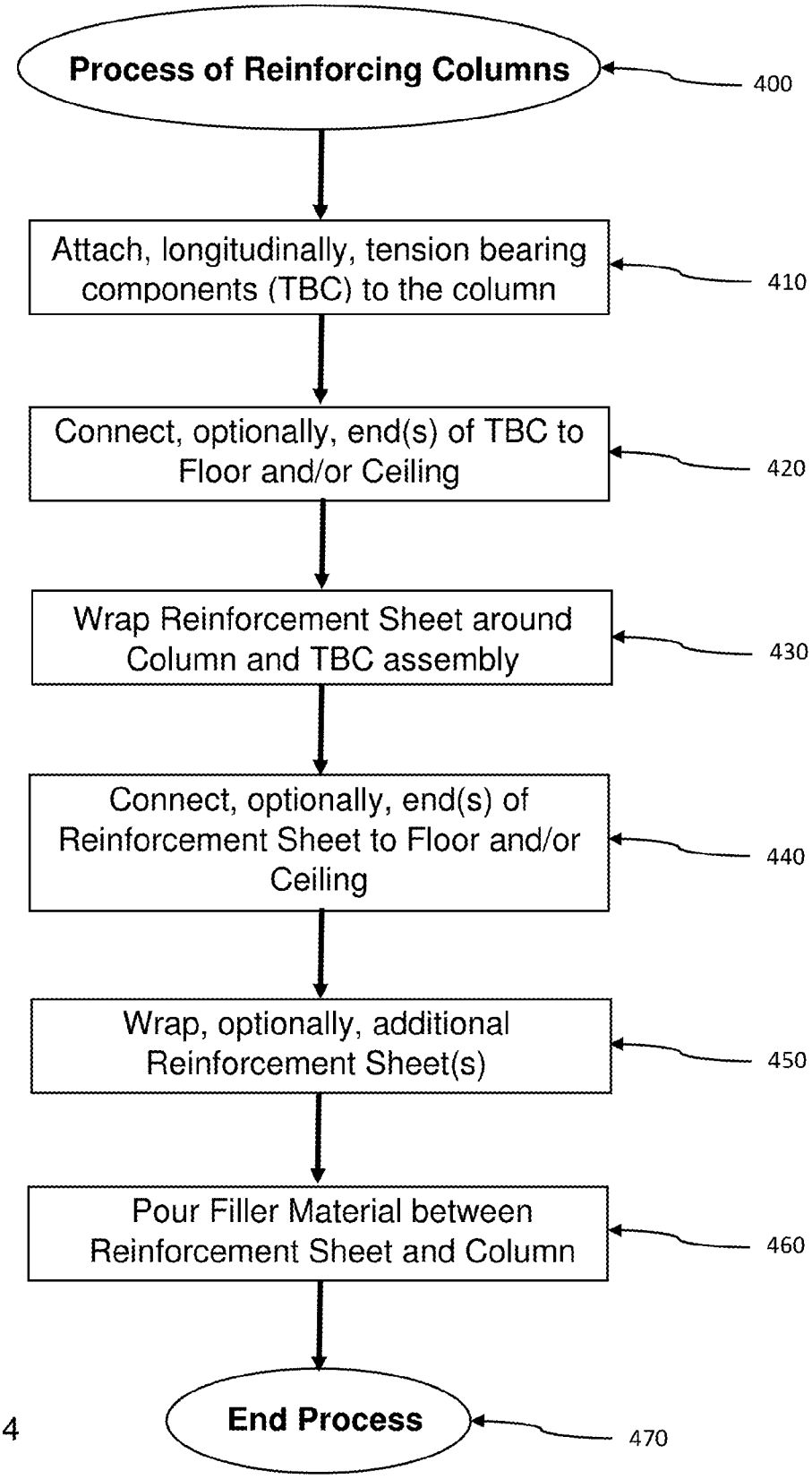
FIG. 4 shows an example process of reinforcing a column using the present method.

FIG. 4 shows an example process of reinforcing a column using the presented method. Process 400 proceeds to block 410 where one or more reinforcement straps/ribbons/rebars are longitudinally and/or circumferentially attached to the column's surface. As described above with respect to FIGS. 2A and 2B, different numbers and types of straps may be used during this step. In various embodiments these reinforcement straps may be attached to the column surface using adhesives, attachment components, fasteners, a combination thereof, and the like. The process proceeds to block 420.

At the optional block 420, one or both ends of the reinforcement rebars or straps are connected to or embedded in the floor and/or ceiling on which or between which the column is built. The process proceeds to block 430. In some embodiments this step may not be optional and one or both ends of the reinforcement rebars or straps may have to be connected to or embedded in the floor and/or ceiling on which or between which the column is built.

At block 430, at least one semi-rigid reinforcement sheet is wrapped (overlappingly or otherwise) around the column and strap assembly to create a shield around the column, such that there remains a cavity between the wrapped sheet (shield) and the column. The process proceeds to block 430.

At another optional block 440, one or both ends of the shield may be connected to or embedded in the floor and/or ceiling on which or between which the column is built. This is in addition or instead of connecting the reinforcement straps/rebars to the floor and/or the ceiling, as mentioned in block 420. The process proceeds to block 450.

At block 450, additional reinforcement sheet layers may be attached on top of the primary shield. The above procedure may be repeated several times in different sequences to construct an SRW of the thickness, composition, and stiffness desired. Such SRW may include many layers of reinforcement sheets and many layers of honeycomb laminate structures or 3D fabric, which may or may not be adjacent to each other. The process proceeds to block 440.

At block 460, filler material such as those enumerated above is poured in the cavity between the shield and the column.

At block 470, the process terminates.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A method of enhancing and/or restoring bending strength of a column, the method comprising:

wrapping a semi-flexible or semi-rigid reinforcement sheet of material around the column wherein the wrapped sheet forms a shield around the column and stays at a distance from the column and creates a cavity between the wrapped sheet and the column;

attaching, longitudinally, at least one reinforcement band to a surface of the column or of the shield or the surfaces of both the column and the shield, wherein the band is not wrapped around the column helically;

anchoring the reinforcement band to a floor and/or to a ceiling, on which or under which the column is erected; and filling the cavity between the shield and the column with filler material, wherein the reinforcement band alone or the reinforcement band and the reinforcement sheet are configured to achieve a desired bending strength for the column.

2. The method of claim 1, wherein the reinforcement band includes fibrous material or is a steel rebar.

3. The method of claim 1, wherein the reinforcement band is epoxied into a hole made into the floor or into the ceiling over which floor or under which ceiling the column is erected.

4. The method of claim 1, wherein the reinforcement sheet has protrusions at least on one side.

5. The method of claim 1, wherein the reinforcement sheet is made of fibrous material.

6. The method of claim 1, wherein the shield is constructed in sections along the column's height and the sections are joined together to make a complete shield.

7. The method of claim 1, wherein the reinforcement band is attached substantially in a plane which passes through a longitudinal axis of the column.

8. The method of claim 1, wherein the filler material is concrete, grout, polymer-modified grout, epoxy grout or epoxy.

9. The method of claim 1, wherein the shield is formed by wrapping multiple sheets of material around the column.

10. A method of reinforcing and/or repairing attachment of a column to its adjacent member(s), the method comprising:

wrapping a flexible reinforcement sheet of material around the column and at a distance from the column to form a shield around the column;

placing, lengthwise, before or after the wrapping of the flexible reinforcement sheet, a reinforcement strip substantially in a plane which passes through a longitudinal axis of the column, wherein the reinforcement strip remains between the shield and the column;

anchoring the reinforcement strip alone or the reinforcement strip and the reinforcement sheet to at least one structural member over which or under which the column is situated; and filling the cavity created between the shield and the column with desired filler material, wherein the reinforcement strip alone or the reinforcement strip and the reinforcement sheet are designed to withstand a desired moment at a point at which the column is connected to the at least one structural member.

11. The method of claim 10, wherein the reinforcement strip includes fibrous material or is a steel rebar or a plastic strap.

12. The method of claim 10, wherein the reinforcement strip is epoxied into a hole made into the floor or into the ceiling over which floor or under which ceiling the column is constructed.

13. The method of claim 10, wherein the reinforcement sheet has protrusions at least on one side.

14. The method of claim 10, the reinforcement sheet is made of fibrous material.

15. The method of claim 10, further comprising placing circumferential reinforcement strips over a surface of the column, of the shield, or of both.

16. The method of claim 10, wherein the shield is formed in more than one section by forming smaller shields around a portion of the column's length and attaching the smaller shields together along the length of the column.

17. The method of claim 10, wherein the desired filler material is concrete, grout, polymer-modified grout, epoxy grout or epoxy.

18. The method of claim 10, wherein the shield is also anchored to the at least one structural member over which or under which the column is situated.

19. A method of reinforcing and/or repairing a column, the method comprising:

placing, lengthwise, a tension bearing strap over the column, wherein the strap is placed over the column substantially parallel to the longitudinal axis of the column and is anchored to a top or to a bottom structural member, or to both, over which structural member or under which structural member the column is placed;

forming a shield around the column; and filling an area between the shield and the column with filler material, wherein the tension bearing strap alone or the tension bearing strap and the shield are configured to achieve a desired bending strength for the column.

20. The method of claim 19, wherein, after curing the filler material, the column, the strap, the shield and the cured filler material become parts of a solid structure.

* * * * *